United States Patent [19]

Cross et al.

[11] 3,990,423

[45] Nov. 9, 1976

[54] ROTARY VALVES

[76] Inventors: Michael Ellison Cross, 52 Bloomfield Ave.; Albert Edward Coles, 366 Bloomfield Road, both of Bath, England

[22] Filed: Sept. 6, 1974

[21] Appl. No.: 504,687

[30] Foreign Application Priority Data

Sept. 7, 1973 United Kingdom ..... 42106/73

[52] U.S. Cl. ..... 123/190 E; 123/190 BB; 123/190 BD; 137/625.22; 251/314

[51] Int. Cl.[2] ..... F01L 7/00

[58] Field of Search.... 123/190 E, 190 DL, 190 BB, 123/190 BD; 137/479, 483, 484, 625.22, 625.47; 251/304, 309, 314, 315

[56] References Cited

UNITED STATES PATENTS

| | | | |
|---|---|---|---|
| 1,649,486 | 11/1927 | Porter | 123/190 E |
| 2,156,960 | 5/1939 | Baer | 123/190 E |

FOREIGN PATENTS OR APPLICATIONS

| | | | |
|---|---|---|---|
| 451,917 | 8/1936 | United Kingdom | 123/190 E |
| 373,660 | 6/1932 | United Kingdom | 123/190 E |
| 423,474 | 2/1935 | United Kingdom | 123/190 E |

OTHER PUBLICATIONS

Smith, Philip H., Valve Mechanisms for High Speed Engines, 1971, pp. 208–215.

*Primary Examiner*—Charles J. Myhre
*Assistant Examiner*—James D. Liles
*Attorney, Agent, or Firm*—Emory L. Groff, Jr.

[57] ABSTRACT

In a rotary valve controlling the inlet of fuel to, and exhaust of combustion products from, a combustion chamber, an improved seal is achieved by providing rigid upstanding lips in the valve housing about the opening of the housing into the combustion chamber, the lips sloping away from the combustion chamber opening and the housing being split diametrically for movement about a hinge pin to provide flexibility to the system and prevent clamping on the valve.

5 Claims, 13 Drawing Figures

ROTARY VALVES

This invention relates to improvements in rotary valves, and in particular to rotary valves which are adapted to control the inlet of combustible mixture to, and exhaust of combustion products from, a combustion chamber: the invention, although not limited thereto, is particularly applicable to rotary valves for use with reciprocating piston internal combustion engines.

In British Patent Specification No. 423,474, there is described a rotary valve for an internal combustion engine, wherein lubricating oil is supplied in copious amounts to the valve and subsequently largely removed so as to minimise the ingress of the oil to the combustion chamber of the engine. In British Patent Specification No. 451,917, there is described the provision of a so-called floating valve housing to which a controlled loading may be applied. The present invention is particularly suited to rotary valves incorporating the general principles described in the said two British Patent Specifications.

According to this invention, there is provided a rotary valve adapted to control the inlet of combustible mixture to, and exhaust of combustion products from, a combustion chamber, which valve comprises a valve housing having an opening communicating with the combustion chamber and a valve member rotatably mounted within the housing, there being upstanding lips provided within the housing around the opening to engage with and effect a seal against the rotatable valve member.

The function of the lips is to seal the valve housing to the valve member in the region of the opening, whereby the ingress of lubricant to the combustion chamber of an engine can be significantly reduced and whereby more efficient combustion of fuel in the combustion chamber can be achieved, with a consequent reduction of the emission of unburned, or incompletely burned, fuel through the exhaust system.

The sealing lips may be provided in various ways. For example, the valve housing may be relieved at an appropriate position around but spaced from the opening into the combustion chamber to leave unrelieved parts forming the lips about the opening. Alternatively the housing may be relieved around the opening, and one or more inserts fitted within the relieved part to constitute the lips. It will therefor be seen that the lips themselves are formed non-resiliently with the valve housing. In either form of the invention, the lips may upstand by the greatest amount immediately adjacent the opening, and opening to the combustion chamber.

In the areas away from the lips, the housing should be formed — for example by machining — to provide a close running fit on the valve member. The lips should upstand from the housing by from 1/300 to 1/1000 of the diameter of the valve member in order to obtain the optimum sealing. The width of the sealing lips may vary widely to suit varying engine conditions; however, it is preferred that the arrangement is such that the bearing pressure on the lips is in the range of 500 to 1000 lbs/sq. inch. These loads are particularly suitable when the portion of the valve member which runs on the lips is made of nitricast iron or hardened steel. In this case the housing should be selected from a compatible metal or metal alloy, such as an aluminium alloy, brass, bronze, tin or white metal.

The expression "hardened" is intended to include a fully heat treated material, i.e. hardened and tempered.

In the form of the invention in which the lips are provided by inserts, any suitable insert material may be used to make the inserts, e.g. lead-bronze or phosphor-bronze. By suitably selecting the bearing metals, the bearing pressures may be preselected and by selecting bearing metals permitting the use of high bearing pressures the effective width of the lips may be reduced. It will be appreciated that, in this form of the invention, there is the possibility that pressure from the combustion chamber may force gas under the lip inserts but this should not occur if the inserts are properly fitted, and in any case will not significantly impair the sealing contact between the lips and the valve member.

The principle of controlled valve loading, as generally described in British Patent Specification No. 451,917, is applied to this invention, providing a selfadjusting substantially no-clearance seal between the valve member and the lips can be obtained by utilising the combustion force, and without causing excessive strain on the valve member and its housing. The controlled valve loading system utilises a valve housing in two parts, the two parts being hinged together. One part, having the opening to the combustion chamber, is attached to or forms a part of the cylinder or cylinder head, whereas the other part is clamped on to the one part by suitable means connected to the engine crankcase. The cylinder itself is spring-urged upwardly away from the crankcase, towards the other part, but may move away from the other part against the spring bias.

When this loading system is applied to this invention, there is a force obtained from the combustion force which acts directly on to the valve member and tends to lift it off the sealing lips in the housing. This force (force A) can be expressed as follows:

Force A = Total combustion force x Area over sealing lips/Cross-sectional area of cylinder The reaction to this force is taken by the other part of the valve housing, at a reaction point (point C) spaced from the centre-line of the valve; this generates an opposed force (force B) on the other part of the valve housing urging the valve member back on to its lips. By suitable selection of the hinge point of the two parts, and of point C, this force B can be arranged to be 8 to 15% greater than force A, thereby maintaining contact between valve member and the lips.

The substantially no-clearance seal between the valve member and the lips relies upon a very thin film of lubricant therebetween, falling within the realms of elastohydro-dynamic lubrication theory. The precise minimum thickness of such a film is within the range of surface asperity heights, and it is found that, in accordance with the formula set out below of Dowson & Higgenson, the actual minimum film thickness obtainable, for diameters of valve members which have thus far been used is of the order of 40 to 50$\mu$ in. (i.e. 1.00 to 1.25$\mu$ m.). This minimum film thickness can be calculated from the dimensionless film thickness parameter H, and a knowledge of the valve member diameter. The formula is:

$$H_{min} = 2.65 \frac{U^{0.70} \times G^{0.57}}{W^{0.13}}$$

where H = dimensionless oil film thickness parameter = h/R $$W = \frac{w}{E'R} = \text{dimensionless load parameter}$$

$$U = \frac{u}{E'R} = \text{dimensionless speed parameter}$$

$G = \alpha E'$ = dimensionless materials parameter
$h$ = actual film thickness
R = radius of rotor
$w$ = load/unit width
E' = Youngs modulus of housing material in the region of the thin film
$u$ = sliding velocity between rotor and housing
$o$ = viscosity of lubricant
$\alpha$ = pressure exponent of viscosity to take account of changes in viscosity of the lubricant caused by the high pressures prevailing.

The surface area of the lips found necessary for such a film to be established may be determined in practice by assuming the reaction force to be evenly distributed over the entire sealing area of the lips. The value of the force can then be expressed as a nominal projected surface pressure, to enable the use of a practical rule of loading to cover a wide range of valve diameters and opening areas. A practical nominal unit pressure may suitably be within the range of 500 to 1000 lbs/sq. inch, as previously mentioned.

By using a rotary valve of this invention in an engine, it is found that the overlap is insufficient to permit mixing of unburnt and burnt fuels in the combustion chamber, the overlap being substantially less than that required by conventional poppet valves. This allows more effective combustion with an increase in power, and minimises the escape of unburnt gases through the exhaust system; this also minimises atmospheric pollution. The invention permits high compression ratios, say 10.5:1, or greater, to be achieved using hydrocarbon fuels of substantially lower octane ratings than those found necessary to produce comparable compression ratios, without pre-ignition, in poppet valve engines. This is due, at least in part, to the fact that in a poppet valve engine, the exhaust valve runs very hot, and may even become red-hot, which promotes pre-ignition. In a rotary valve engine, however, no one part of the valve member is constantly in the combustion chamber, and the valve member, as a whole, thus runs considerably cooler than its counterpart in a poppet valve engine.

By way of illustration only, the invention will be further explained, reference being made to the accompanying drawings, in which.

Figure 1:
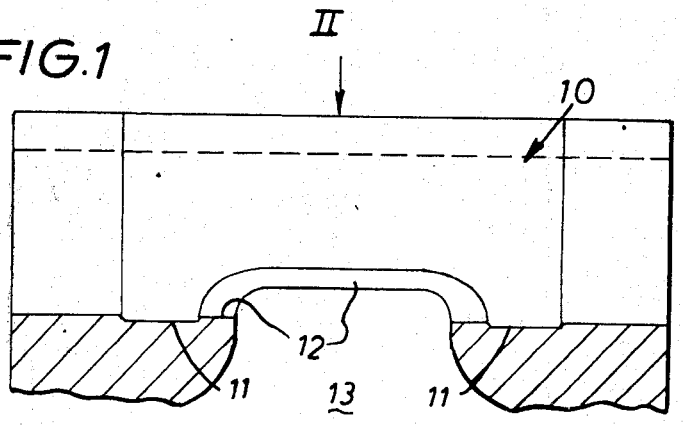
FIG. 1 is a sectional part-view through valve housing constructed in accordance with this invention.
Figure 2:
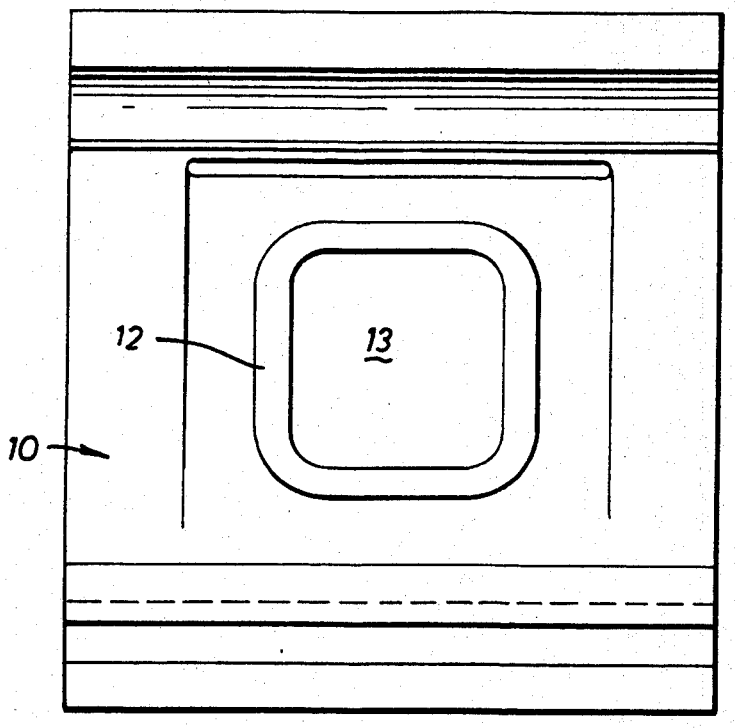
FIG. 2 is view of the complete valve housing, taken on arrow II on FIG. 1 internal combustion engine.
Figure 3:
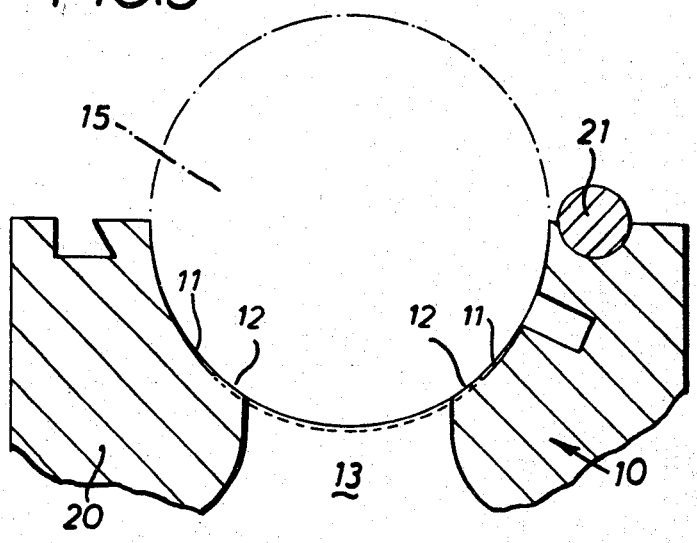
FIG. 3 is a part cross-section of the valve housing.
Figure 4:
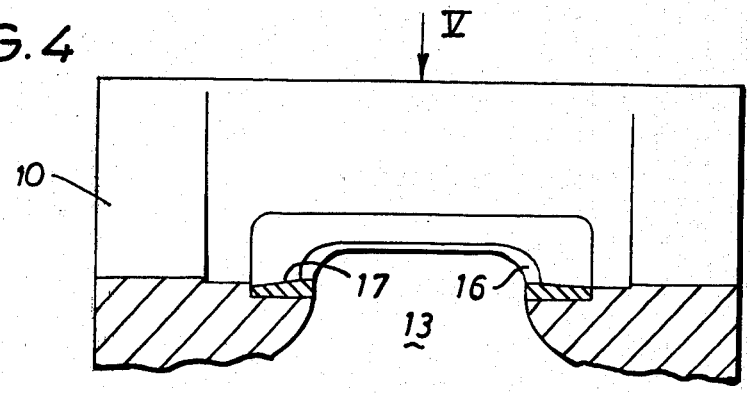
FIG. 4 shows an alternative construction of valve housing to that shown in FIG. 1.
Figure 5:
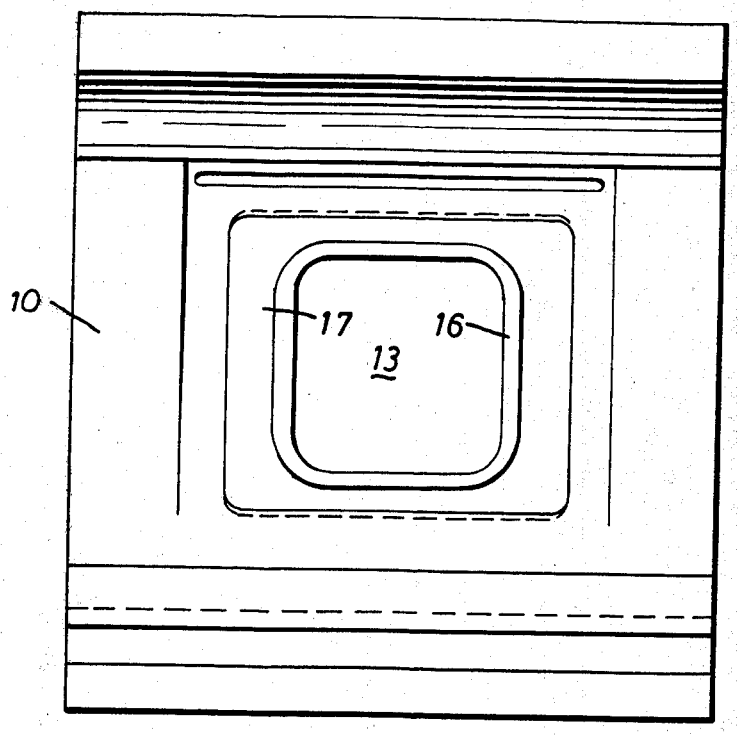
FIG. 5 is a view of the complete valve housing, taken on arrow V on FIG. 4.
Figure 6:
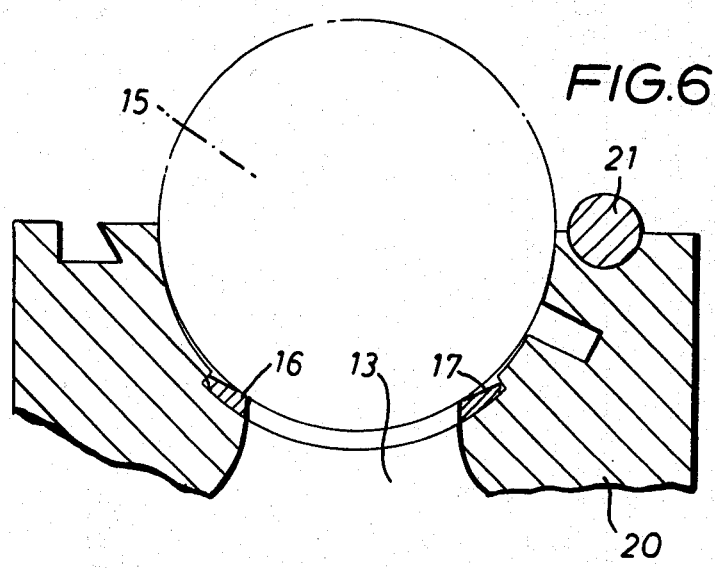
FIG. 6 is a part cross section of the valve housing of FIGS. 4 and 5.

In the form of the invention shown in FIGS. 1, 2 and 3, a valve housing 10 is relieved as shown at 11 to provide sealing lips 12 about an opening 13 to the combustion chamber of an engine cylinder; these lips provide a seal between a rotary valve member 15 and the opening 13.

FIGS. 4, 5, 6 and 7 show an alternative form of the invention, wherein the sealing lips are provided by an insert 16 fitted into a relieved part of the housing 10 around the opening 13. The insert 16 is bevelled at 17, as shown, to improve the sealing effect.

Figure 8:
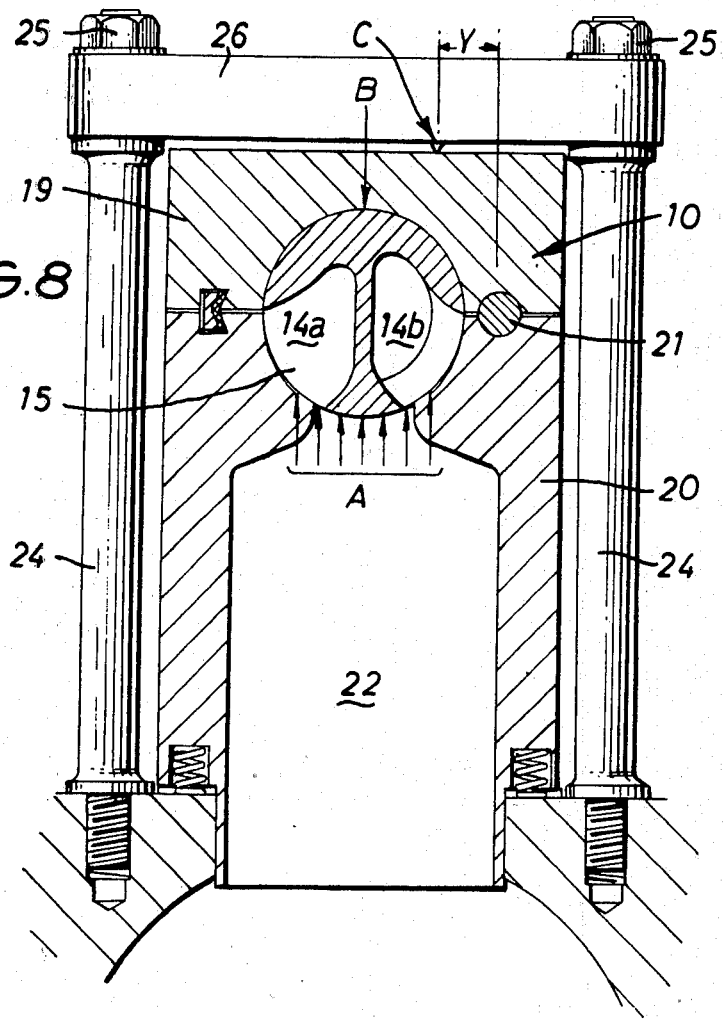
FIG. 8 is a diagrammatic longitudinal section of part of an internal combustion engine, depicting the principle of controlled valve loading.

Referring to FIG. 8, it can be seen that the valve housing 10, for the valve member 15, is split diametrically into two portions, namely, a cap portion 19 and a base portion 20, hinged at 18 about a hinge pin 21.

The valve member 15 has inlet and exhaust ports **14*a* and 14*b* which, in turn came into and out of communication with the opening 13. The valve housing parts are clamped together by a cross beam 26 bearing on the cap part 19, the beam 26 being adjustably mounted on pillars 24 by means of nuts 25. The base part 20 is mounted for movement parallel to the length of the pillars 24, and is biased upwardly by springs between the base part and the engine crankcase, to which the pillars are attached. In operation, a force A is generated on the base part 20 and valve member 25 by virtue of the combustion of fuel and an oxidant in the cylinder 22, and tends to lift the valve member 15 off the lips 12 or (or 16). This force is transferred to the cross beam 26 at point C, which is selected to give a reaction force B on the rotary valve member of 8 to 15% greater than the force tending to lift the valve member off its seating on the lips 12 (or 16). It will be appreciated that the load at the reaction point C is equal to the total combustion force, and point C is designed to be located at a distance Y from the hinge pin 21 so that, by the principle of moments, the downward force B applied at the vertical centre line of the rotary valve 15** exceeds force A by 8 to 15%. The downward force B, being greater than the upward force A, thus prevents the valve member from lifting away from the lips.

Figure 7:
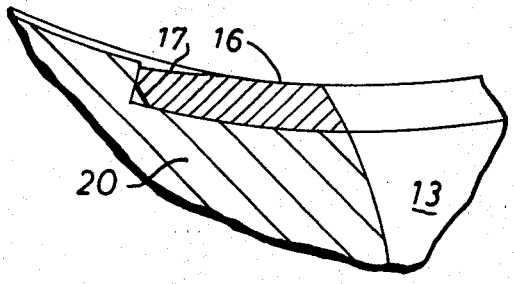
FIG. 7 is an enlarged detail of FIG. 5.
Figure 9:
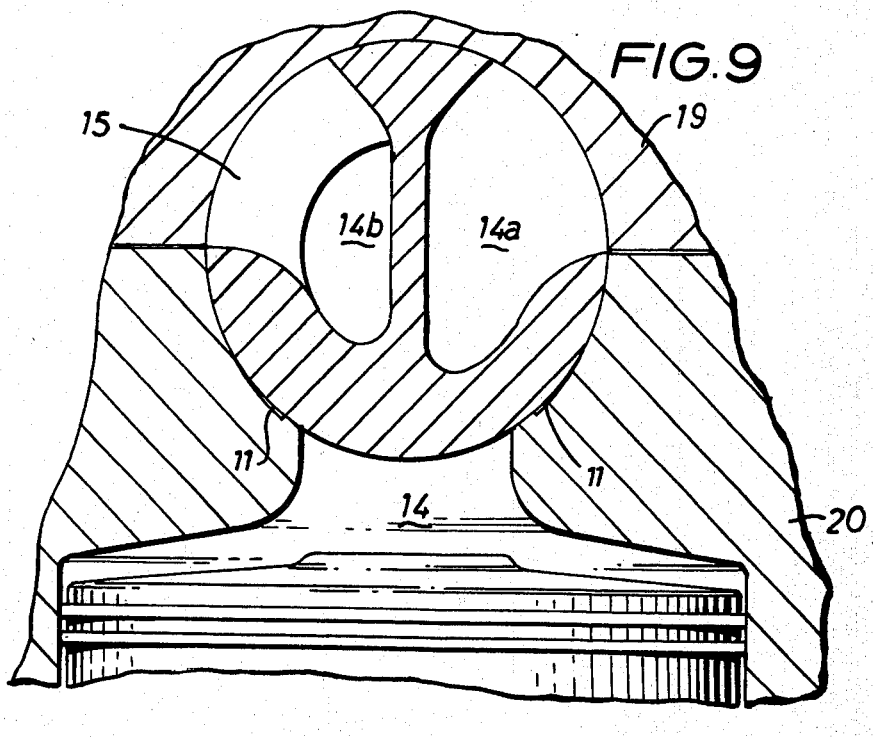
FIG. 9 is an enlarged detail of FIG. 8.
Figure 10:
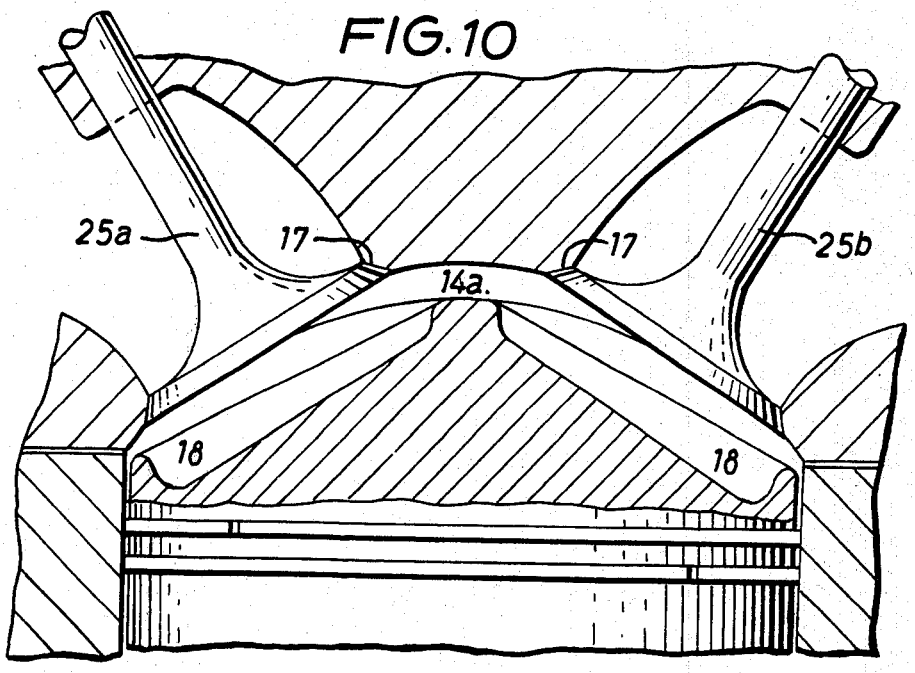
FIG. 10 is a comparative detail related to a poppet valve engine.
Figure 11:
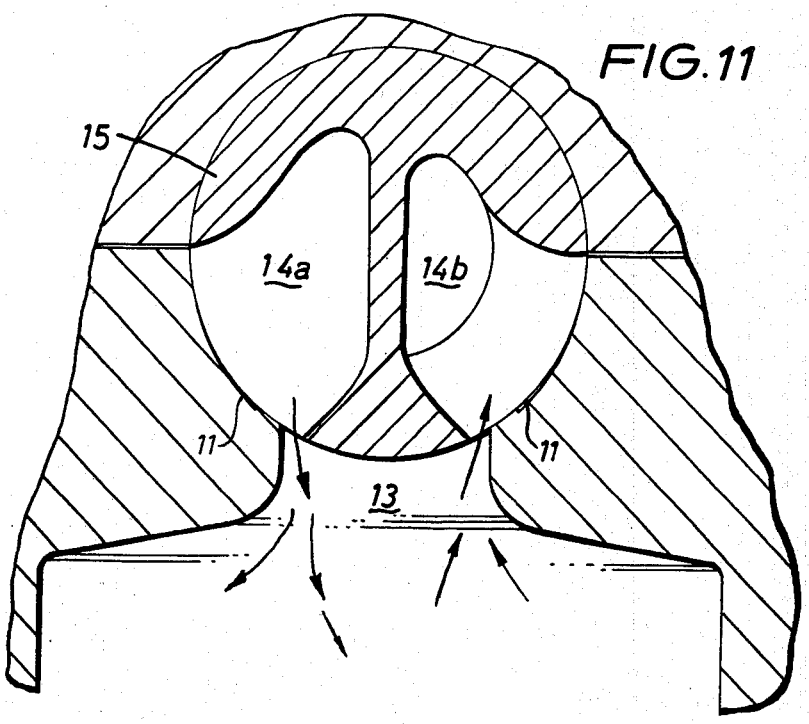
FIG. 11 is a detail showing the flow of inlet and exhaust gases in an engine having a rotary valve.
Figure 12:
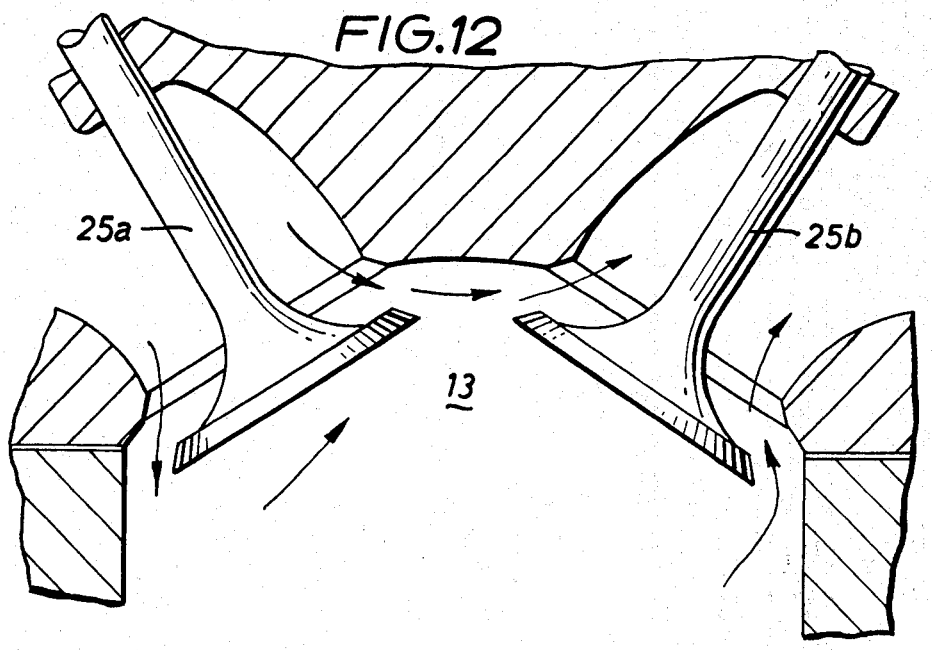
FIG. 12 is a comparative detail showing the flow of inlet and exhaust gases in a poppet valve engine.
Figure 13:
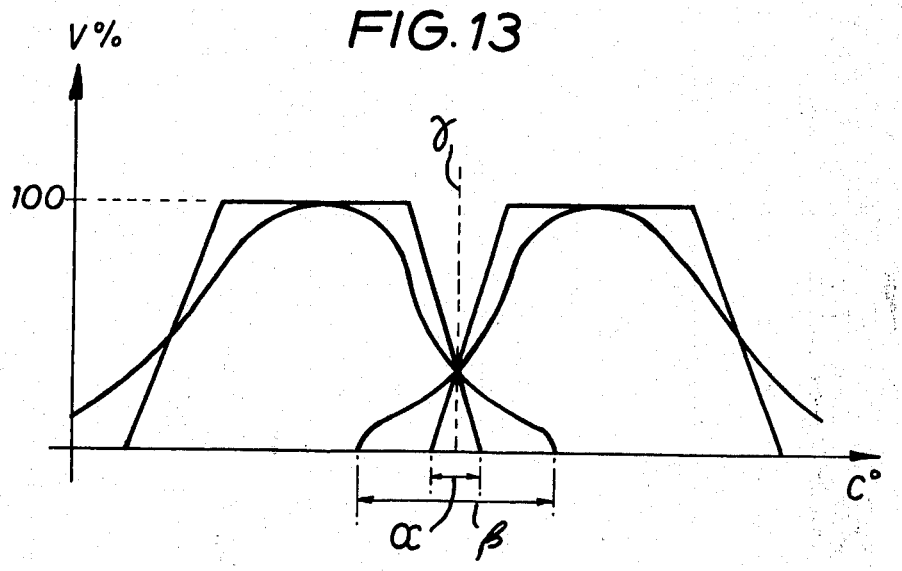
FIG. 13 is a graph comparing the operation of a rotary valve with poppet valves.

Comparing FIG. 9 (rotary valve engine) with FIG. 10 (poppet valve engine), the combustion chamber 14 shown in FIG. 7 has smooth walls without obstructions to gas flow, whereas the combustion chamber **14*a* of the poppet valve engine (FIG. 8) is not smooth being obstructed by the inlet and exhaust valves 25*a* and 25*b* as well as by valve clearance pockets 18 which need to be provided in the top of the piston. The adverse effect of the obstructed combustion chamber of the poppet valve engine is aggravated on engines of high compression ratios, e.g. 10.5 : 1 or more, and with bore/stroke ratios of from 1 : 1 to as much as 1.5 : 1 or even 3 : 1, in contrast to the unobstructed combustion chamber of the rotary valve engine which is markedly more effective at the compression and bore/stroke ratios abovementioned. The superiority of combustion in the rotary valve engine compared with the poppet valve engine is illustrated by reference to FIGS. 11 (rotary valve) and 12 (poppet valve) in which the separation of the inlet and exhaust gas flow is compared. In the rotary valve engine the opening and closing of the inlet and exhaust ports is markedly faster than in the poppet valve engine, so that the fuel introduced through the inlet port 14***a* to the combustion chamber 13 does not appreciably enter the exhaust port and hence the exhaust gases contain substantially no unburnt fuel. In the poppet valve engine, fuel introduced through the inlet valve 25*a* tends to flow, as shown by the arrows, towards the exhaust valve 25*b* to an appreciable extent. The opening and closing of the ports of the rotary valve of the invention, compared with that of the poppet valve engine, is illustrated in the graph of FIG. 11, which plots valve opening (V%) against crank shaft rotation, in degress (C°). The topdead centre position for the piston of the engine is shown at $\gamma$, and it can be seen that the valve overlap $\alpha$ for a rotary valve engine is very much smaller in this region than the overlap $\beta$ for a poppet valve engine. This is due to the very much higher rates of opening and closing of the ports which can be achieved in a rotary valve engine.

A particular advantage of this invention is the low temperature at which the valve member operates. This effect, in combination with those already discussed above, allows the use of low octane fuels with high compression ratios without pre-ignition being caused. This is not possible in a poppet valve engine because the exhaust valve runs very hot — and often red-hot — and hence causes pre-ignition unless high octane fuels are used.

What is claimed is :

1. In combination with an internal combustion engine, a rotary valve housing defining a bore and a valve member rotatably mounted within the said housing, the housing also defining an opening communicating with a combustion chamber, the valve member serving to control the flow of combustible mixture and combustion products through said opening, there being upstanding lips formed rigidly in the valve housing surrounding the opening communicating with the combustion chamber, said lips serving to engage and effect a seal with the said rotatable valve member, the lips upstanding by their greatest amount immediately adjacent the said opening, the said housing being split diametrically into two parts, one part defining the said opening and the two parts being connected together by a hinge member, a resilient bias being provided to urge the two parts together.

2. A rotary valve housing defining a bore and a valve member rotatably mounted therein as claimed in claim 1, in which the lips upstand by their greatest amount immediately adjacent said opening and slope away therefrom.

3. A rotary valve housing defining a bore and a valve member rotatably mounted therein, as claimed in claim 1, in which the lips are formed by relieving the housing around its position of opening into the combustion chamber to leave upstanding lips.

4. A rotary valve housing defining a bore and a valve member rotatably mounted therein, as claimed in claim 1, in which the valve housing is relieved around its position of opening into the combustion chamber and the lips are provided by one or more inserts fitted into the said relieved part of the housing.

5. A rotary valve defining a bore and a valve member rotatably mounted therein, as claimed in claim 1, characterized in that the said lips upstand from the housing at their greatest extent by from 1/300 to 1/1000 of the diameter of the rotary valve.

* * * * *